US006715613B2

(12) United States Patent
Eeles et al.

(10) Patent No.: US 6,715,613 B2
(45) Date of Patent: Apr. 6, 2004

(54) SCREENING MODULE AND A SCREENING ASSEMBLY INCLUDING SUCH MODULE

(75) Inventors: John William Eeles, Eleebana (AU); Peter Martin Olsen, Toronto (AU)

(73) Assignee: USF Johnson Screens Pty Ltd., Queensland (AU)

( * ) Notice: Subject to any disclaimer, the term of this patent is extended or adjusted under 35 U.S.C. 154(b) by 0 days.

(21) Appl. No.: 10/149,006

(22) PCT Filed: Dec. 6, 2000

(86) PCT No.: PCT/AU00/01500

§ 371 (c)(1),
(2), (4) Date: Sep. 25, 2002

(87) PCT Pub. No.: WO01/41944

PCT Pub. Date: Jun. 14, 2001

(65) Prior Publication Data

US 2003/0052048 A1 Mar. 20, 2003

(30) Foreign Application Priority Data

Dec. 9, 1999 (AU) ..... PQ 4558

(51) Int. Cl.[7] ..... B07B 1/46
(52) U.S. Cl. ..... 209/405
(58) Field of Search ..... 209/405, 408, 209/399, 403, 412

(56) References Cited

U.S. PATENT DOCUMENTS 3,980,555 A * 9/1976 Freissle ..... 209/408
4,219,412 A * 8/1980 Hassall ..... 209/399
4,661,245 A * 4/1987 Rutherford et al. ..... 209/399
4,674,251 A * 6/1987 Wolff ..... 52/309.15
5,755,334 A * 5/1998 Wojcik et al. ..... 209/399
6,253,926 B1 * 7/2001 Woodgate ..... 209/399

FOREIGN PATENT DOCUMENTS

| | | |
|---|---|---|
| AU | B-97218/98 | 4/1999 |
| AU | WO 200066281 A | * 11/2000 |
| DE | 198 60 612 | 6/2000 |
| JP | 09029173 A | 2/1997 |

OTHER PUBLICATIONS

International Search Report document, PCT Publication No. WO 01/41944; publication date: Jun. 14, 2001.

* cited by examiner

*Primary Examiner*—Donald P. Walsh
*Assistant Examiner*—Joseph C Rodriguez
(74) *Attorney, Agent, or Firm*—Greenberg Traurig, LLP; Charles Berman, Esq.

(57) ABSTRACT

A screening module for a screening assembly includes a substantially rectangular, planar screening member having a plurality of screening apertures extending through it the member having a pair of sides extending parallel to a direction of flow of material over the member and a pair of sides extending transverse to a direction of flow of material over the member. A mounting means is formed integrally with the screening member as a one-piece unit for securing the member to an underlying structure. A part of the mounting means is arranged along each side of the screening member and only the parts of the mounting means associated with one pair of sides having reinforcing with the parts of the mounting means associated with the other pair of sides being without reinforcing.

10 Claims, 7 Drawing Sheets

SCREENING MODULE AND A SCREENING ASSEMBLY INCLUDING SUCH MODULE

FIELD OF THE INVENTION

This invention relates to a screening module. More particularly, the invention relates to a screening module and to a screening assembly including such module.

SUMMARY OF THE INVENTION

According to the invention, there is provided a screening module for a screening assembly, the module including a substantially rectangular, planar screening member having a plurality of screening apertures extending through it, the member having a pair of sides extending parallel to a direction of flow of material over the member and a pair of sides extending transverse to a direction of flow of material over the member;

a mounting means formed integrally with the screening member as a one-piece unit for securing the member to an underlying structure, a part of the mounting means being arranged along each side of the screening member and only the parts of the mounting means associated with one pair of sides having reinforcing with the parts of the mounting means associated with the other pair of sides being without reinforcing; and a locating means associated with the parts of the mounting means of at least one pair of sides of the screening member for locating the screening member relative to the underlying structure, the locating means projecting beneath an underside of the parts of the mounting means to abut against an associated part of the underlying structure for inhibiting flexing and dislodgement of the module relative to the underlying structure.

As indicated above, the screening panel is substantially rectangular. The shorter sides of the panel may extend in a direction parallel to the direction of flow of screening material over the module, in use. These shorter sides shall be referred to as the longitudinal sides with the longer sides being referred to as the transverse sides.

Preferably, only the longitudinal sides have the reinforcing. The reinforcing may be steel reinforcing.

The locating means is, preferably, associated with the parts of the mounting means having the reinforcing, ie. the longitudinal sides.

The locating means may be arranged operatively inwardly of its associated part of the mounting means, the reinforcing extending into the locating means.

Each part of the mounting means may be in the form of a clip arranged along its associated side of the screening member, the clip defining a receiving slot for receiving a complementary part of the underlying structure. The locating means may be in the form of a shoulder arranged inwardly of the slot of its associated clip and projecting beneath an underside of the clip to abut against the associated part of the underlying structure. The reinforcing may define a pair of spaced, parallel plates, one arranged on each side of the slot. One of the plates may be longer to extend into the shoulder. The plates may be interconnected by a bridging portion arranged in the screening member above the slot, in use. Thus, the reinforcing may straddle the slot of the clip.

The module may be a moulding of a synthetic plastics material. The plastics material may be a polyurethane. The type of polyurethane selected may be of a strength which allows a predetermined amount of flexing of the screening module, in use, to aid in screening of materials.

The invention extends also to a screening assembly which includes:

a plurality of screening modules, each as described above; and a framework defining a structure underlying the screening modules, the screening modules being removably secured to the framework.

The framework may be a demountable framework. The framework may includes rails to which the screening modules are releasably secured via the mounting means of the modules.

BRIEF DESCRIPTION OF THE DRAWINGS

The invention is now described by way example with reference to the accompanying diagrammatic drawings in which.

DETAILED DESCRIPTION OF THE DRAWINGS

Figure 1:
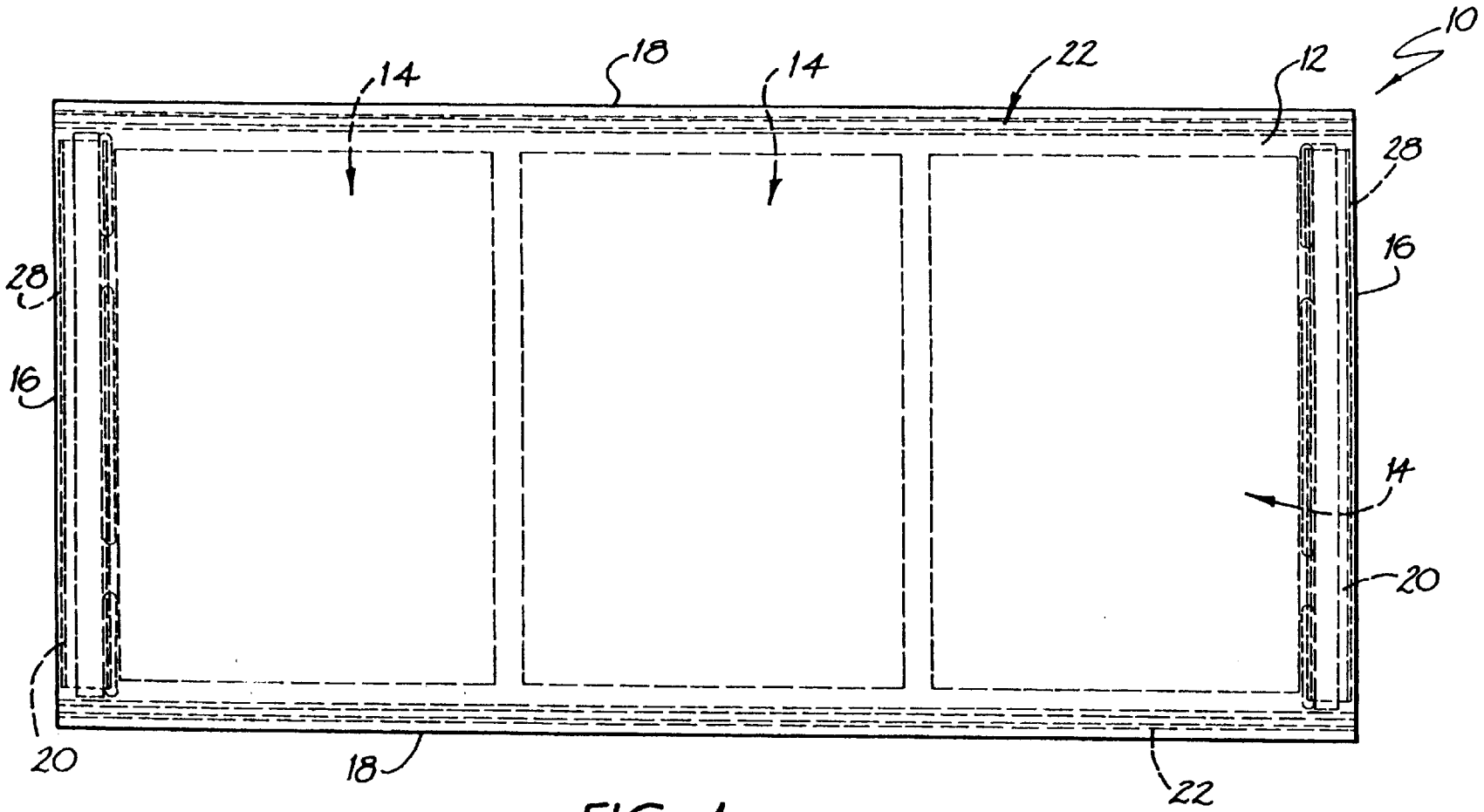
FIG. 1 shows a plan view of a screening module in accordance with the invention.
Figure 2:
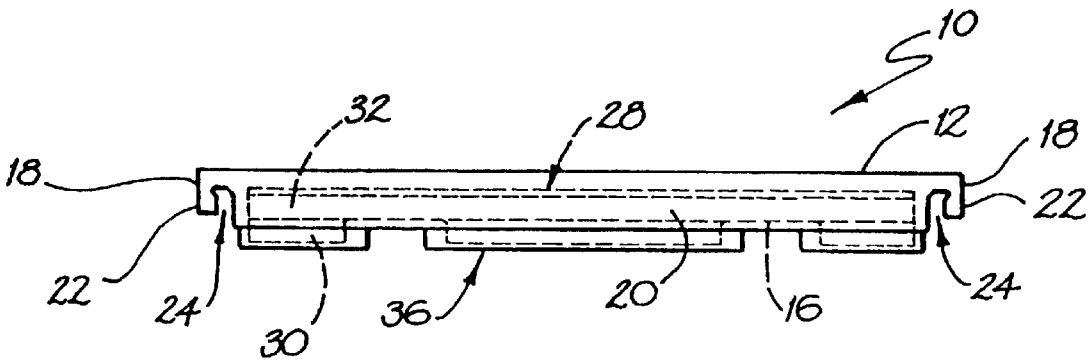
FIG. 2 shows an end view of the module.
Figure 3:
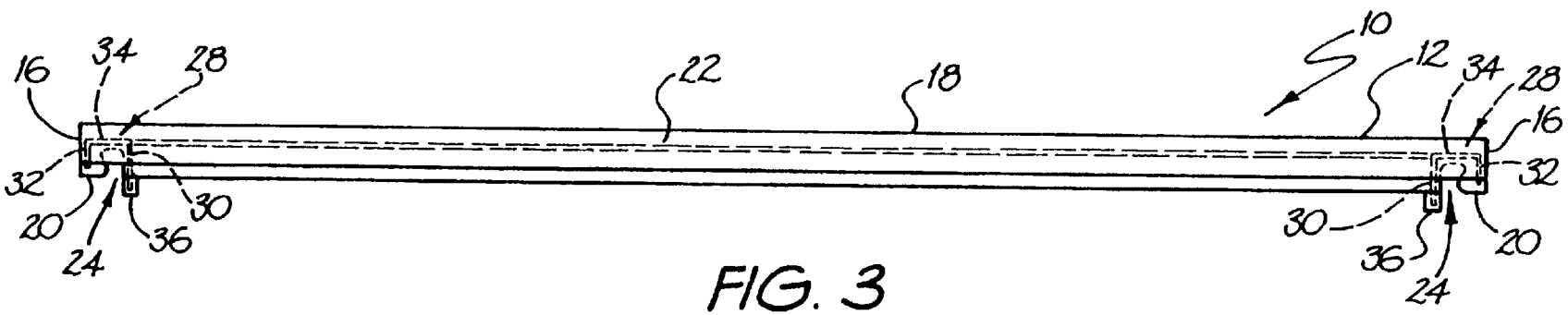
FIG. 3 shows a side view of the module.

Referring firstly to FIGS. 1 to 3 of the drawings, a screening module, in accordance with the invention, is illustrated and is designated generally by the reference numeral 10. The screening module 10 comprises a substantially rectangular, planar screening member or deck 12 which defines a plurality of screening apertures therethrough illustrated schematically by panels 14 in FIG. 1 of the drawings. The module 10 has a pair of transversely spaced, longitudinal sides 16 and a pair of longitudinally spaced, transverse sides 18. The longitudinal sides 16, in use, extend parallel to a direction of flow of material over the module 10.

A mounting means in the form of a clip-like formation or clip 20 is arranged along each longitudinal side 16. Similarly, a mounting means in the form of a clip 22 is arranged along each transverse side 18. The clips 20 and 22 are shown in greater detail in FIGS. 2 and 3 of the drawings. It is to be noted that each clip 20, 22 defines a slot 24 therein which clips over a rail 26 (FIG. 4) as will be described in greater detail below.

The module 10 is formed integrally as a one-piece unit and is a moulding of a synthetic plastics material. More particularly, a flexible polyurethane material is used for the module 10.

To ensure that there is not too great a degree of flexing, in use, which would result in the module 10 being torn loose from its underlying structure, at least a part of the module 10 is reinforced.

In this regard, the sides 16 of the module 10 contain reinforcing 28 with the sides 18 being without reinforcing.

The reinforcing in the sides 16 extends into the clips 20 associated with the sides 16. As illustrated in FIG. 3 of the drawings, the reinforcing 28 straddles the slots 24 of the clips 20.

Thus, the reinforcing 28 comprises a plate 30 arranged inwardly of the slot 24 with a further plate 32 arranged outwardly of the slot 24. The plates 30 and 32 are interconnected by a bridging portion 34 arranged in the deck 12.

In addition, also to control flexing of the module 10, a locating means in the form of a shoulder 36 is arranged along each side 16 inwardly of the clip 24. Each shoulder 36 abuts against a side rail (not shown) extending in a direction parallel to the direction of flow of material and controls flexing of the module 10. It is to be noted that, to improve the rigidity of the shoulder 36, the reinforcing plate 30 of the reinforcing 28 extends into the shoulder 36.

Figure 4:
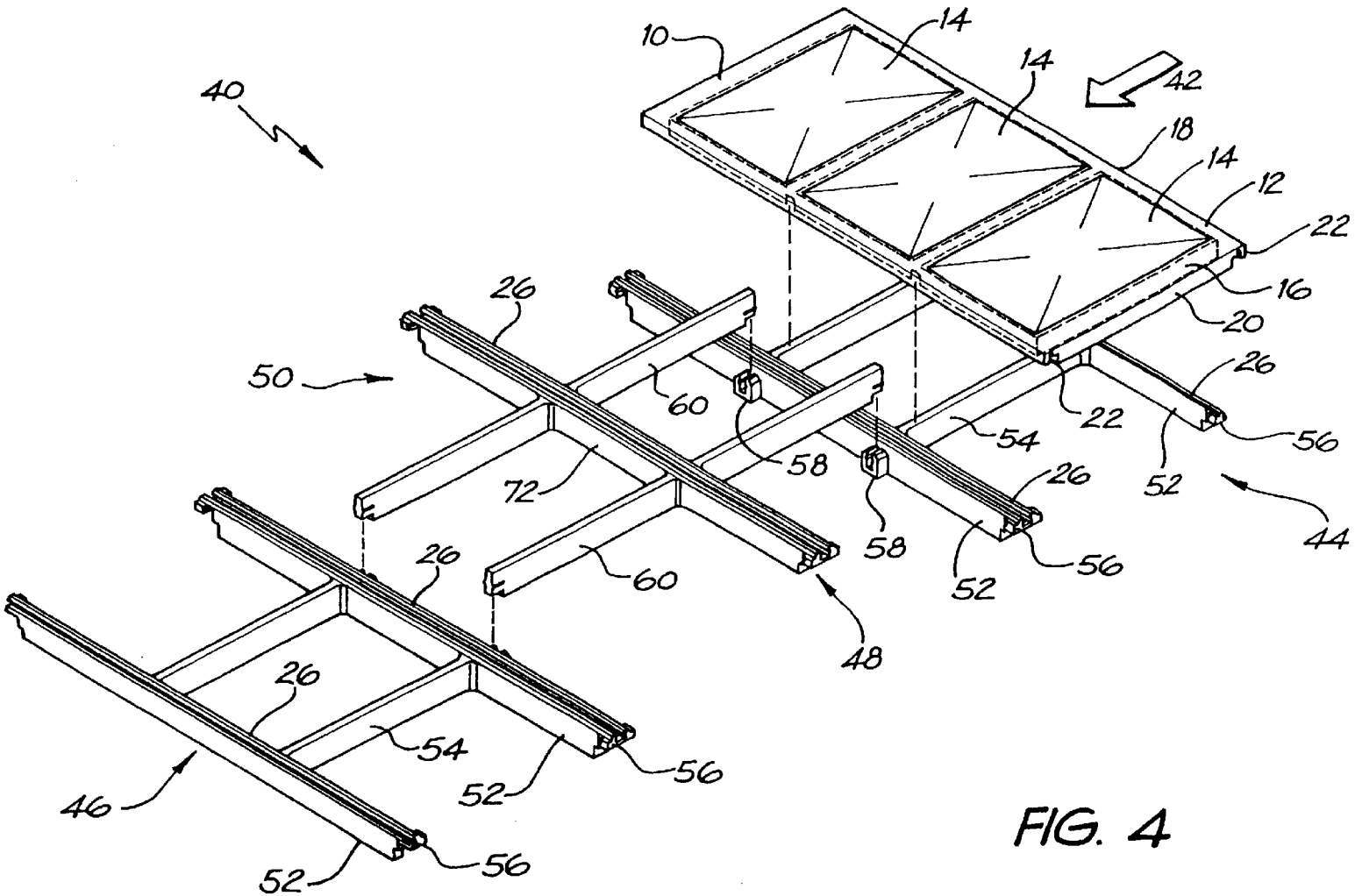
FIG. 4 shows a three dimensional, exploded view of a screening assembly, also in accordance with the invention.

Referring now to FIG. 4 of the drawings, a screening assembly is illustrated and is designated generally by the reference numeral 40. The screening assembly 40 includes a plurality of screening modules 10, only one of which is shown. The screening modules 10 are arranged in side-by-side and end-to-end relationship to form a screening surface over which material passes to be screened. The material moves in the direction of arrow 42.

The screening assembly includes a feed end frame 44, a discharge end frame 46 and an intermediate, connecting, frame 48. These frames clip into standard rails (not shown) to form an underlying structure 50 for the modules 10.

Figure 5:
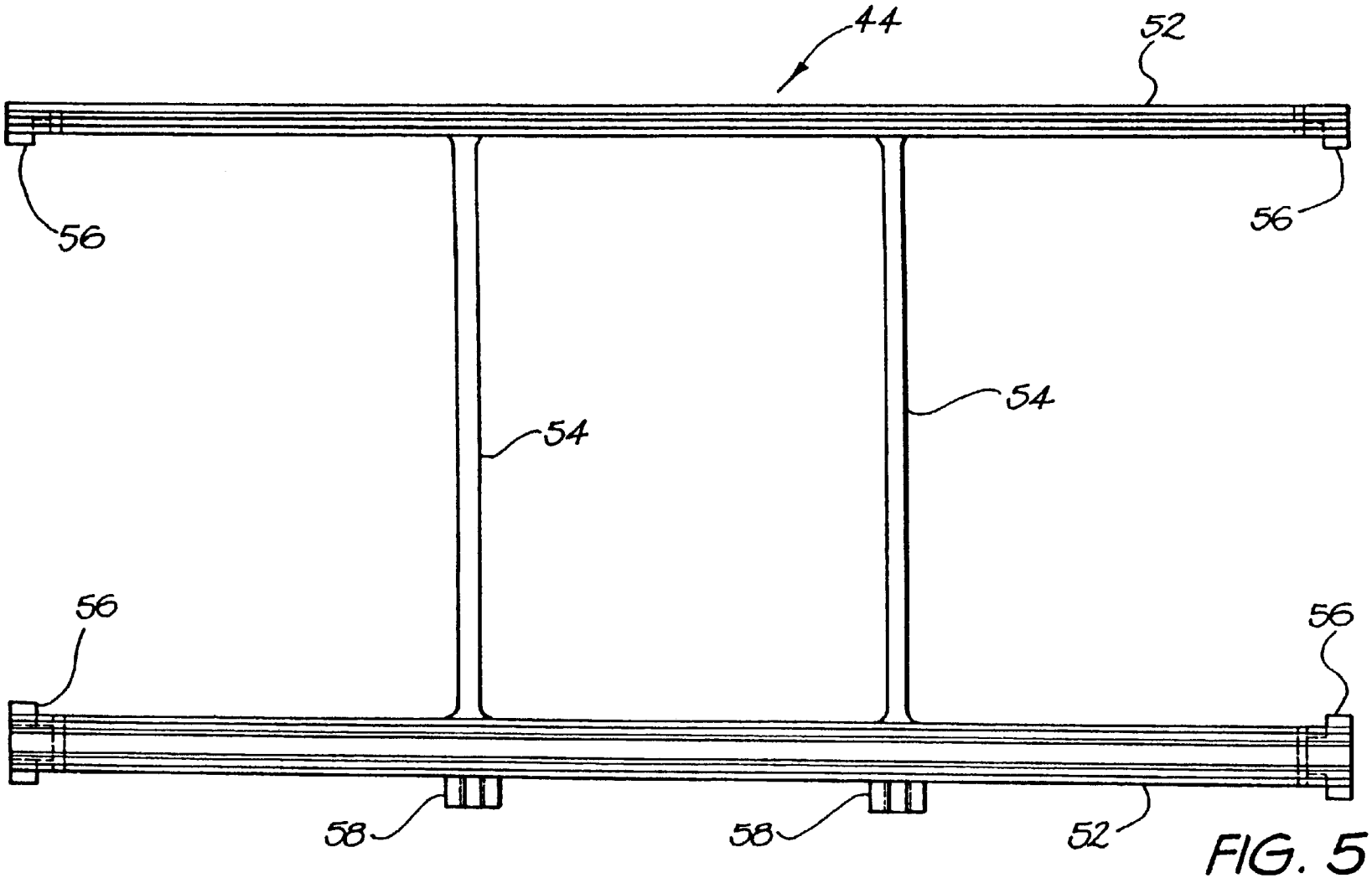
FIG. 5 shows a plan view of a component of the assembly.
Figure 6:
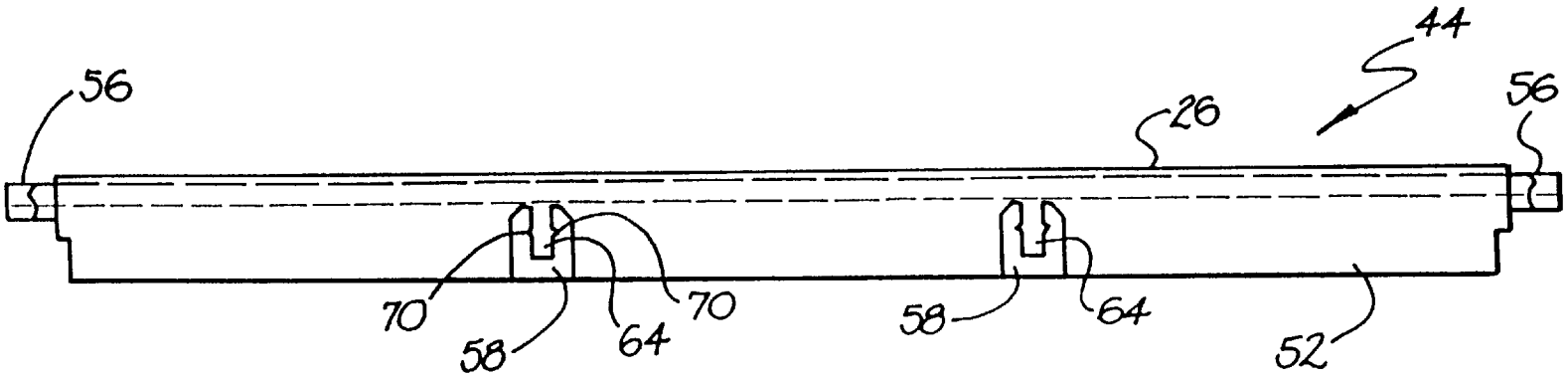
FIG. 6 shows a side view of the component of FIG. 5.
Figure 7:
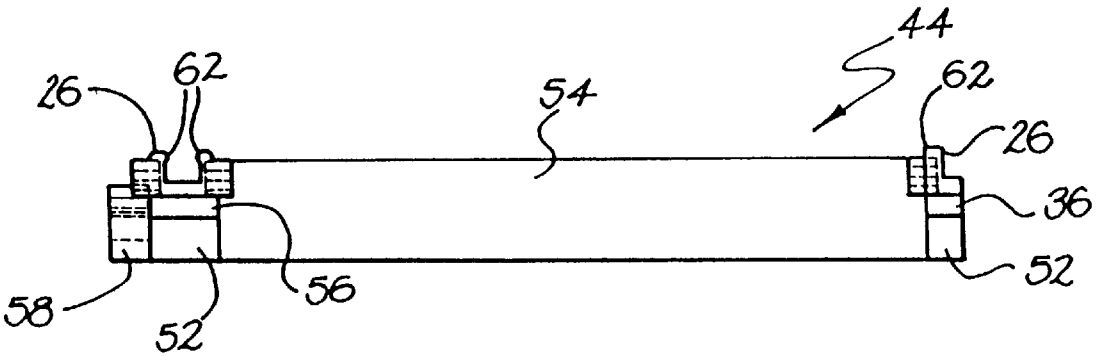
FIG. 7 shows an end view of the component of FIG. 5.

The feed end frame 44 and the discharge end frame 46 are of substantially the same construction and, accordingly, only one of the frames, the feed end frame 44, is discussed in greater detail. As illustrated in FIG. 5 of the drawings, the feed end frame 44 comprises a ladder-like structure having a pair of side rails 52 interconnected by cross-members 54. Ends of the rails 52 have engaging formations 56 for engaging and being secured to underlying rails.

On one side of one of the side rails 52, opposite its junction with the cross-members 54, receiving formations 58 are defined for receiving connecting members 60 of the intermediate frame 48.

The receiving rail 26 runs along the top of each rail 52. Each receiving rail 26 includes clips 62 which are received in the slots 24 of the clips 20, 22 of the modules 10. The modules 10 are clipped on to the rails 26 by means of a dedicated "roll-on" tool to attach the modules 10 to the underlying structure 50 securely.

Referring again to the receiving formations 58, it is to be noted that each receiving formation 58 defines a slot 64 in which an end 66 of one of the connecting members 60 of the intermediate frame 48 is received. The end 66 of the connecting members 60 has ribs 68 which engage recesses 70 in the slots for connecting the intermediate frame 48 to the feed end frame 44 and the discharge end frame 46.

Figure 8:
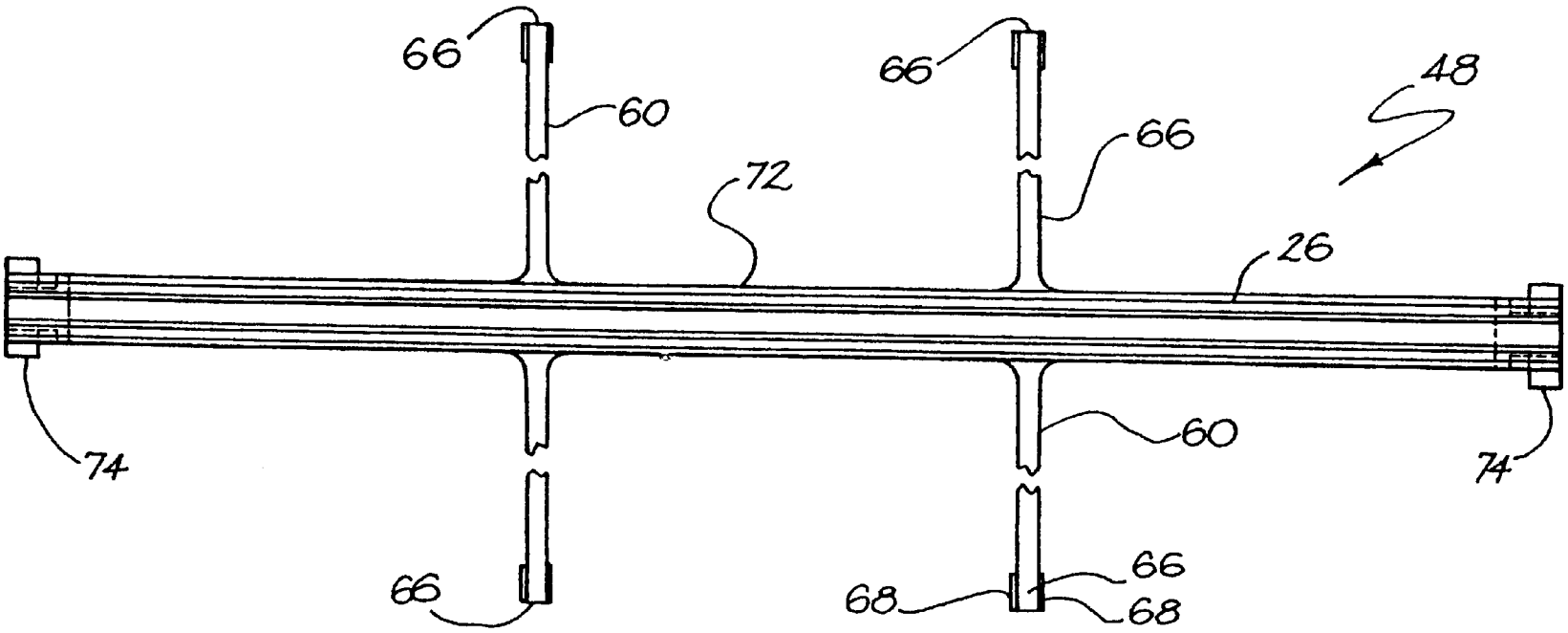
FIG. 8 shows a plan view of another component of the assembly.
Figure 9:
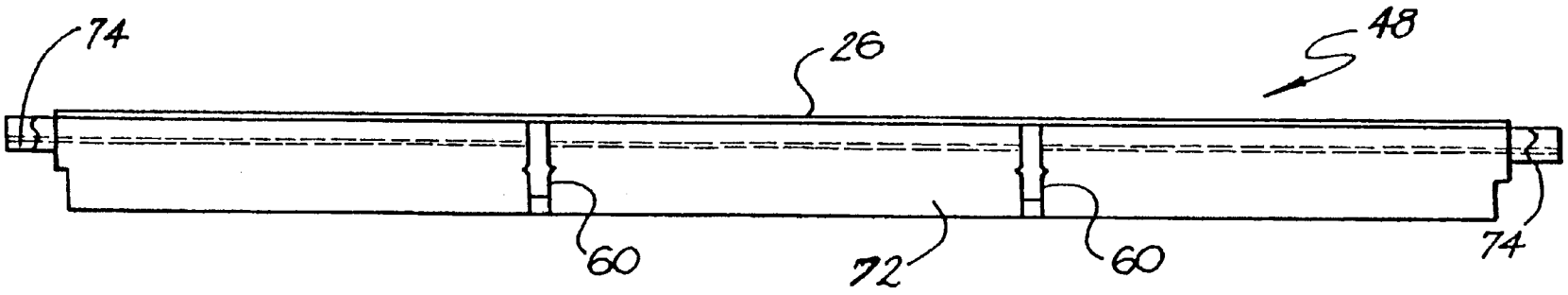
FIG. 9 shows a side view of the component of FIG. 8.
Figure 10:
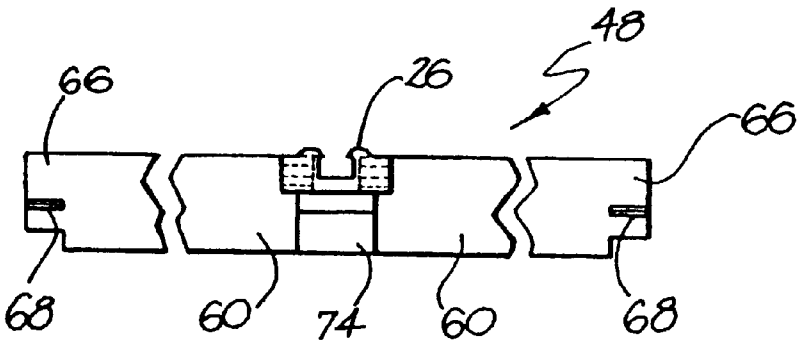
FIG. 10 shows an end view of the component of FIG. 8.

The intermediate frame 48 has a central spine 72 (FIGS. 8 to 10) from which the connecting members 60 project at right angles. A connecting formation 74 is arranged at each end of the spine 72 for connecting the intermediate frame 48 to the underlying rails.

As in the case of the feed end frame 44 and the discharge end frame 46, a connecting rail 26 is arranged on top of the spine 72 for securing the modules 10 to the intermediate frame 48.

It is a particular advantage of the invention that a screening module 10 is provided which can readily be "peeled" off the underlying structure 50 to be replaced without the need to disassemble the underlying structure 50. Also, due to the demountability of the underlying structure 50, should a component of the structure 50 be damaged, it can be readily replaced without replacing the whole underlying structure.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

What is claimed is:

1. A screening module for a screening assembly, the module including a substantially rectangular, planar screening member having a plurality of screening apertures extending through it, the member having a pair of sides extending parallel to a direction of flow of material over the member and a pair of sides extending transverse to a direction of flow of material over the member;

a mounting means formed integrally with the screening member as a one-piece unit for securing the member to an underlying structure, a part of the mounting means being arranged along each side of the screening member and only the parts of the mounting means associated with one pair of sides having reinforcing contained within the parts with the parts of the mounting means associated with the other pair of sides being without reinforcing; and a locating means associated with the parts of the mounting means of at least one pair of sides of the screening member for locating the screening member relative to the underlying structure, the locating means projecting beneath an underside of the parts of the mounting means to abut against an associated part of the underlying structure for inhibiting flexing and dislodgment of the module relative to the underlying structure, at least the parts of the mounting means associated with the at least one pair of sides of the screening member being arranged outwardly of the locating means.

2. The module of claim 1 in which the locating means is associated with the parts of the mounting means having the reinforcing.

3. The module of claim 2 in which the locating means is arranged operatively inwardly of its associated part of the mounting means, the reinforcing extending into the locating means.

4. The module of claim 1 in which each part of the mounting means is in the form of a clip arranged along its associated side of the screening member, the clip defining a receiving slot for receiving a complementary part of the underlying structure.

5. The module of claim 4 in which the locating means is in the form of a shoulder arranged inwardly of the slot of its associated clip and projecting beneath an underside of the clip to abut against the associated part of the underlying structure.

6. The module of claim 1 which is a moulding of a synthetic plastics material.

7. The module of claim 6 in which the plastics material is a polyurethane.

8. A Screening assembly which includes:

a plurality of screening modules, each as claimed in claim 1; and a framework defining a structure underlying the screening modules, the screening modules being removably secured to the framework.

9. The assembly of claim 8 in which the framework is a demountable framework.

10. The assembly of claim 8 in which the framework includes rails to which the screening modules are releasably secured via the mounting means of the modules.

* * * * *